US006936111B2

(12) United States Patent
Koppelkamm et al.

(10) Patent No.: US 6,936,111 B2
(45) Date of Patent: Aug. 30, 2005

(54) METHOD AND DEVICE FOR WASHING A RUBBER BLANKET

(75) Inventors: Günther Koppelkamm, Neuensalz (DE); Klaus Töpfer, Mühltroff (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/717,100

(22) Filed: Nov. 19, 2003

(65) Prior Publication Data

US 2004/0250836 A1 Dec. 16, 2004

(30) Foreign Application Priority Data

Nov. 28, 2002 (DE) ..... 102 55 799

(51) Int. Cl.[7] ..... B08B 7/00

(52) U.S. Cl. ..... 134/6; 15/256.51; 15/256.52; 101/416.1; 101/423; 101/417; 101/418; 101/419; 101/420; 101/425; 134/42; 134/32; 134/33

(58) Field of Search ..... 15/256.51, 256.52; 101/416.1, 423, 417, 418, 419, 420, 425; 134/6, 42, 32, 33

(56) References Cited

U.S. PATENT DOCUMENTS

| | | | | | |
|---|---|---|---|---|---|
| 4,066,017 | A | * | 1/1978 | Garcowski et al. | 101/425 |
| 5,385,095 | A | * | 1/1995 | Waizmann | 101/424 |
| 5,404,819 | A | * | 4/1995 | Hishinuma et al. | 101/425 |
| 5,732,631 | A | * | 3/1998 | Walther et al. | 101/424 |
| 5,797,325 | A | * | 8/1998 | Ebina et al. | 101/425 |
| 2004/0173240 | A1 | * | 9/2004 | Harris | 134/2 |

FOREIGN PATENT DOCUMENTS

GB 1170499 11/1969

OTHER PUBLICATIONS

Wolgang Walenski, Der Rollen Offset druck, Geschichte Moderne Technik Materialien, 1995, pp. 337–345.

* cited by examiner

*Primary Examiner*—Sharidan Carrillo
(74) *Attorney, Agent, or Firm*—Cohen, Pontani, Lieberman & Pavane

(57) ABSTRACT

During a washing cycle of a rubber blanket on a blanket cylinder some revolutions of the blanket cylinder are initially performed during which the cleaning element is lifted off the blanket cylinder temporarily when the clamping channel passes under the cleaning element.

8 Claims, 1 Drawing Sheet

METHOD AND DEVICE FOR WASHING A RUBBER BLANKET

BACKGROUND OF THE INVENTION

1. Field of the Invention

The invention relates to a method and a device for washing a rubber blanket which is situated on a blanket cylinder of a rotary press.

2. Description of the Related Art

A washing device is known for washing a rubber blanket situated on a blanket cylinder of a rotary press (cf. the book by Walenski, . . . mentioned below), in which device a cloth soaked with a washing liquid is pressed against the rotating blanket cylinder. It is disadvantageous here that the upright cloth which has been set against the blanket cylinder pushes dirt and ink ahead of it on the rubber blanket. When a clamping channel passes under the cloth, dirt and ink are pushed into the channel. This leads to dirt and ink increasingly collecting in the channel, with the result that the clamping channel has to be cleaned by the printer from time to time. Narrow clamping channels fill up correspondingly quickly, so that the said channels have to be cleaned more frequently.

SUMMARY OF THE INVENTION

It is an object of the invention to provide a method and a device for washing a rubber blanket, with which only small amounts of dirt and ink collect in the clamping channel of the rubber blanket.

According to the invention, less dirt and ink are pushed into the clamping channel by virtue of the cleaning element being lifted off during some revolutions of the blanket cylinder in a washing cycle, so that the clamping channel does not need to be cleaned so frequently either. In this way, the downtimes of the rotary press are reduced.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
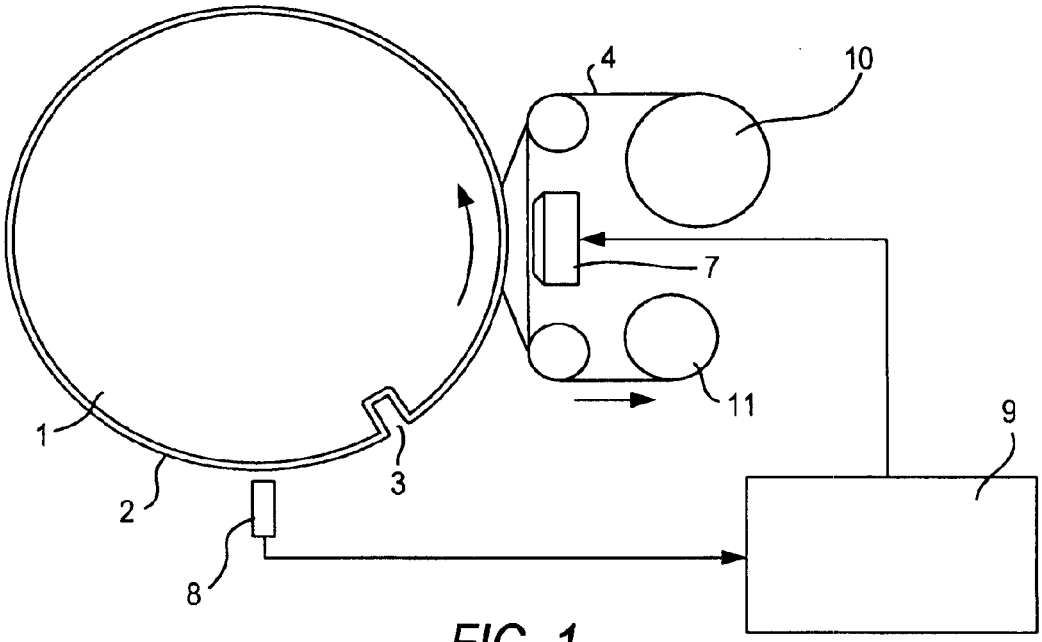
FIG. 1 is a schematic view of a blanket cylinder having a washing device arranged on it.

FIG. 1 shows a blanket cylinder 1 onto which a rubber blanket 2 is clamped. The ends of the latter are clamped in a clamping channel 3 which extends in the axial direction of the blanket cylinder 1. A washing device for washing the rubber blanket 2, which operates using a cloth 4, is arranged on the blanket cylinder 1. The cloth 4 is guided from a clean-cloth roll 10 to a dirty-cloth roll 11. It can be pressed against the blanket cylinder 1 by a throwing-on device 7. A transmitter 8 which signals the position of the clamping channel 3 is connected to a control unit 9, whose output is connected to the throwing-on device 7.

In order to wash the rubber blanket 2, the cloth 4 is pressed against the blanket cylinder 1 and thus onto the rubber blanket 2. The blanket cylinder initially performs some revolutions, for example six revolutions, during which the cloth 4 is temporarily lifted off the blanket cylinder 1 when the clamping channel 3 passes under the said cloth 4. The transmitter 8 signals the position or the passage of the clamping channel 3 under the cloth 4 to the control unit 9 by means of a corresponding signal. The control unit 9 then correspondingly activates the throwing-on device. For the throwing-on operation, the throwing-on device 7 extends, for example, a diaphragm or a plunger and moves the cloth 4 into the pressing position (shown by a dashed line). In FIG. 1, the thrown-off position of the cloth 4 is shown by a solid line. The washing cycle is then concluded by a few revolutions, for example one to two revolutions, during which the cloth is pressed continuously against the blanket cylinder 1. In this way, the region of the rubber blanket 2 at the clamping channel 3 is also washed. Further detailed descriptions of the washing operation can be dispensed with, such as the supply of washing liquid or the inching on of the cloth 4, as this is familiar to the person skilled in the art and described, for example, in the book by Walenski, Der Rollenoffsetdruck [Web-fed offset printing], 1st edition 1995, Fachschriftenverlag, Fellbach, pages 340 to 345. The transmitter for the position of the clamping channel 3 can be arranged, for example, on the blanket cylinder 1 itself. A signal from the machine control system can, however, also be used.

In the further exemplary embodiments, if components broadly coincide with the previous exemplary embodiment, the reference symbols are retained or provided with the suffix ".1".

Figure 2:
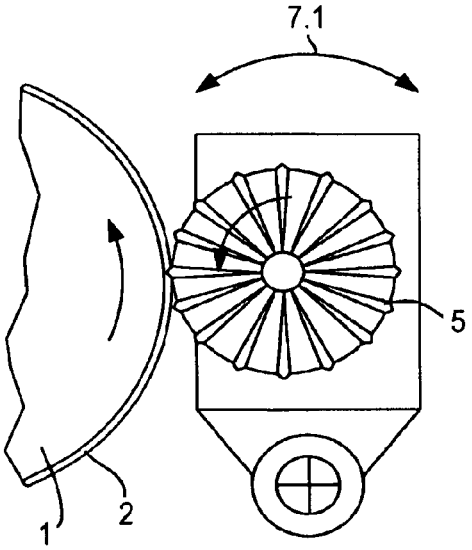
FIG. 2 is a schematic view of a design variant of FIG. 1.

According to FIG. 2, the washing device which is arranged on the blanket cylinder 1 has a brush 5 as cleaning element which can be pivoted onto and away from the rubber blanket 2 by means of a throwing-on device 7.1. The throwing-on device 7.1 is in turn activated (not shown for the sake of simplicity) by a control unit 9 to which a position transmitter 8 (likewise not shown) for the clamping channel 3 is connected. The first revolutions of the washing cycle are again performed in such a way that the brush 5 is temporarily pivoted away when the clamping channel 3 passes under the brush 5. Finally, one or a few revolutions of the blanket cylinder 1 follow, during which the brush 5 remains thrown on.

Figure 3:
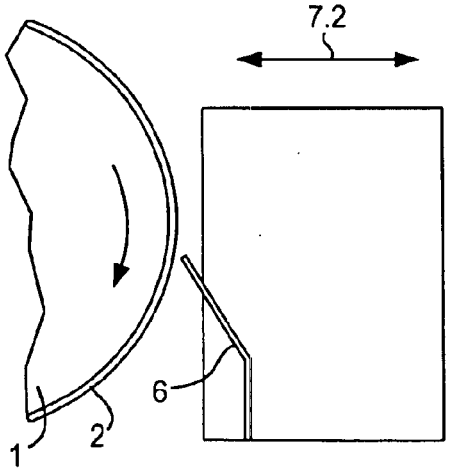
FIG. 3 is a schematic view of a further design variant of FIG. 1.

According to FIG. 3, a washing device has a doctor 6 as cleaning element which can be moved against or away from the blanket cylinder 1 using a throwing-on device 7.2. In a manner analogous to the previous exemplary embodiments, the throwing-on device 7.2 is connected to a control unit 9 (not shown), to which a transmitter (likewise not shown) for the position of the clamping channel 3 is connected. For the washing operation, initially some revolutions of the blanket cylinder 1 are again performed, during which the doctor 6 is moved away as it passes the clamping channel 3. Finally, some revolutions are performed during which the doctor 6 remains thrown onto the blanket cylinder 1.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for washing a rubber blanket on a blanket cylinder of a rotary press, said blanket having ends which are clamped in a clamping channel extending axially on the circumferential surface of said cylinder, said method comprising:

providing a cleaning element which can be pressed against blanket cylinder as said cylinder rotates, wherein said cleaning element is one of a cloth, a brush, and a doctor;

rotating said cylinder for a plurality of initial revolutions;

pressing said cleaning element against said blanket cylinder during said initial revolutions;

lifting said cleaning element off of said blanket cylinder each time the clamping channel passes under the cleaning element during said initial revolutions;

rotating said cylinder for at least one subsequent revolution following said initial revolutions; and pressing said cleaning element against said blanket cylinder continuously during said at least one subsequent revolution.

2. The method of claim 1 wherein said cleaning device is a cloth.

3. The method of claim 1 wherein said cleaning device is a brush.

4. The method of claim 1 wherein said cleaning device is a doctor.

5. Apparatus for washing a rubber blanket on a blanket cylinder of a rotary press, said blanket having ends which are clamped in a clamping channel extending axially on the circumferential surface of said cylinder, said apparatus composing:

a cleaning element which can be pressed against blanket cylinder as said cylinder rotates, wherein said cleaning element is one of a cloth, a brush, and a doctor;

a throwing-on device for pressing the cleaning element against the blanket cylinder and lifting the cleaning element off the blanket cylinder;

a transmitter which signals the position of the clamping channel as the blanket cylinder rotates; and a control unit having an input connected to said transmitter and an output connected to said throwing-on device, said control unit being effective to cause said throwing-on device to press said cleaning element against said blanket cylinder during a plurality of initial revolutions of said cylinder and to lift said cleaning element off of said blanket cylinder each time the clamping channel passes under the cleaning element during said initial revolutions, and to cause said throwing-on device to press said cleaning element against said blanket cylinder continuously during at least one subsequent revolution following said initial revolutions.

6. The apparatus of claim 5 wherein said cleaning device is a cloth.

7. The apparatus of claim 5 wherein said cleaning device is a brush.

8. The apparatus of claim 5 wherein said cleaning device is a doctor.

* * * * *